US005280300A

United States Patent [19]

Fong et al.

[11] Patent Number: 5,280,300

[45] Date of Patent: Jan. 18, 1994

[54] METHOD AND APPARATUS FOR REPLENISHING AN INK CARTRIDGE

[75] Inventors: Jon Fong; David Hunt; Michael Borer, all of San Diego, Calif.

[73] Assignee: Hewlett-Packard Company, Palo Alto, Calif.

[21] Appl. No.: 750,360

[22] Filed: Aug. 27, 1991

[51] Int. Cl.[5] ..... B41J 2/175

[52] U.S. Cl. ..... 346/1.1; 346/140 R; 141/1; 141/2; 141/18; 141/98

[58] Field of Search ..... 346/140; 222/189, 422, 222/481, 95, 105; 101/366; 137/614, 614.05, 614.06, 545, 550; 285/9.2; 141/1, 2, 18, 98, 22–; B41J 2/175

[56] References Cited

U.S. PATENT DOCUMENTS

| | | | |
|---|---|---|---|
| 4,119,034 | 10/1978 | Wax | 346/140 R X |
| 4,149,172 | 4/1979 | Heinzl et al. | 346/140 R |
| 4,496,959 | 1/1985 | Frerichs | 346/140 R |
| 4,503,443 | 3/1985 | Dagna et al. | 346/140 R |
| 4,689,641 | 8/1987 | Scardovi et al. | 346/140 R |
| 4,931,811 | 6/1990 | Cowger et al. | 346/140 R |
| 4,959,667 | 9/1990 | Kaplinsky | 346/140 R |

*Primary Examiner*—Benjamin R. Fuller
*Assistant Examiner*—Alrick Bobb

[57] ABSTRACT

The invention relates generally to refillable ink cartridges for computer controlled ink jet printers and more specifically to apparatus for refilling collapsible ink bags which are maintained at sub-atmospheric pressure within such equipment. A mass of porous capillary material disposed in an ink supply passageway provides a capillary valve which prevents flow of ink when one side of the valve is unwetted.

12 Claims, 3 Drawing Sheets

FIG. 1
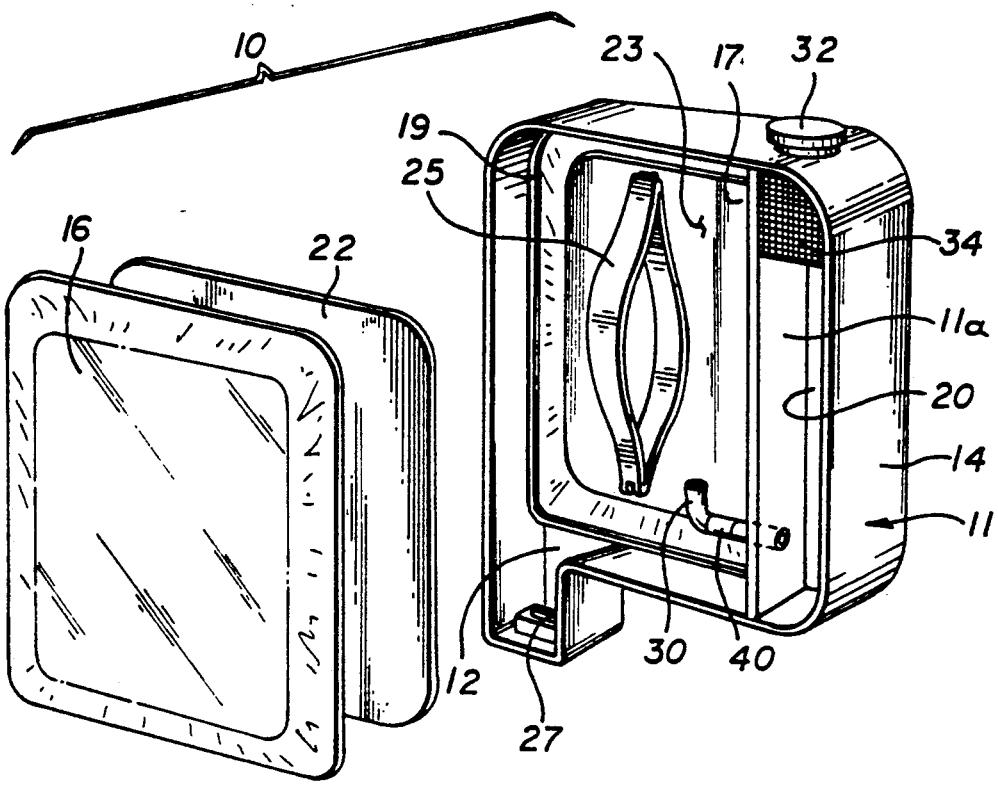
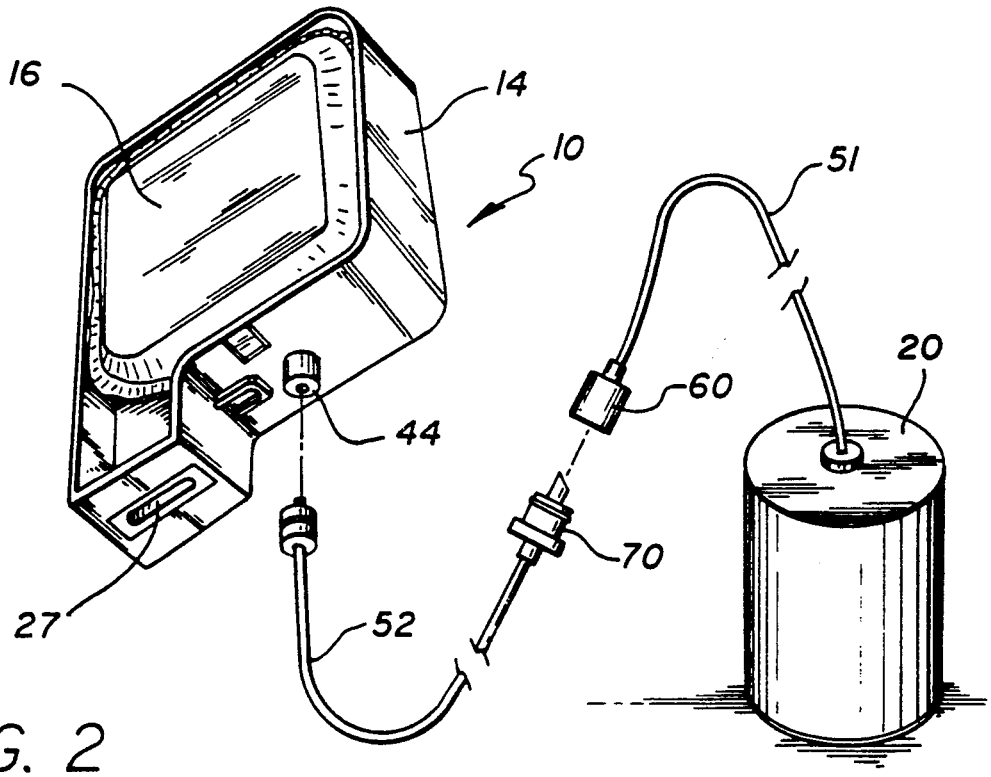
FIG. 2

METHOD AND APPARATUS FOR REPLENISHING AN INK CARTRIDGE

CROSS REFERENCES TO RELATED APPLICATIONS, IF ANY

None.

BACKGROUND OF THE INVENTION AND PRIOR ART

The invention relates generally to ink cartridges for computer controlled printers and more specifically to apparatus for refilling collapsible ink bags within such cartridges.

Computer-controlled printers are well known and replaceable pen and ink cartridges for such printers are likewise well known. These cartridges contain an ink reservoir bag which is maintained at sub-atmospheric pressure to minimize the likelihood of ink inadvertently leaking therefrom.

The ink delivering nozzle of the cartridge assembly normally remains primed by ink so that it is ready to print on demand and remains so as ink is withdrawn and the ink bag progressively collapses as ink is withdrawn therefrom. De-priming of the nozzle occurs substantially only when the ink volume is exhausted.

One example of a prior art ink replenishment system includes a double-septum needle (nozzle) arrangement which requires a number of parts and which is therefore comparatively expensive to manufacture. A dual mechanical valving set-up as found on compressed gas cylinders has also been used as have three way valves. All of these prior art techniques for ink replenishment are relatively complex, expensive and bulky.

The manner in which the invention deals with the prior art disadvantage to produce a novel and advantageous new combination will be evident as this specification proceeds.

SUMMARY OF THE INVENTION

The general objective of the invention may be broadly stated as the provision of a combination for introduction of fluid into a closed negative pressure fluid container without also introducing air. More particularly, the invention was developed to facilitate the refilling of the ink bag in a computer controlled printer pen cartridge.

In the novel combination, a capillary valve communicates with the interior of the ink bag and with an ink reserve chamber. Ink flows through the capillary valve until the ink bag is filled or until the reserve chamber ink supply is exhausted at which time the capillary valve prevents the introduction of air into the ink bag. The reserve chamber can be constructed integrally within the cartridge or it may be a remote supply of ink used with special connectors and the capillary valve to periodically refill the ink bag.

The details of the preferred embodiments of the invention will be evident as this description continues. The capillary valve is inexpensive, has no moving parts and prevents air flow therethrough and also prevents ink flow therethrough unless both sides of the valve are in contact with liquid.

BRIEF DESCRIPTION OF THE DRAWINGS

FIG. 1 is an exploded perspective of a printer ink cartridge including an internally disposed ink bag and refilling chamber with a capillary valve therebetween.

FIG. 2 is a perspective view like FIG. 1 showing an alternative means for refilling the negative pressure ink bag from a remote refilling container of ink which also is maintained at sub-atmospheric pressure by the use of a fluid bridge in which a capillary valve is disposed.

DESCRIPTION OF THE PREFERRED EMBODIMENT

Figure 3:
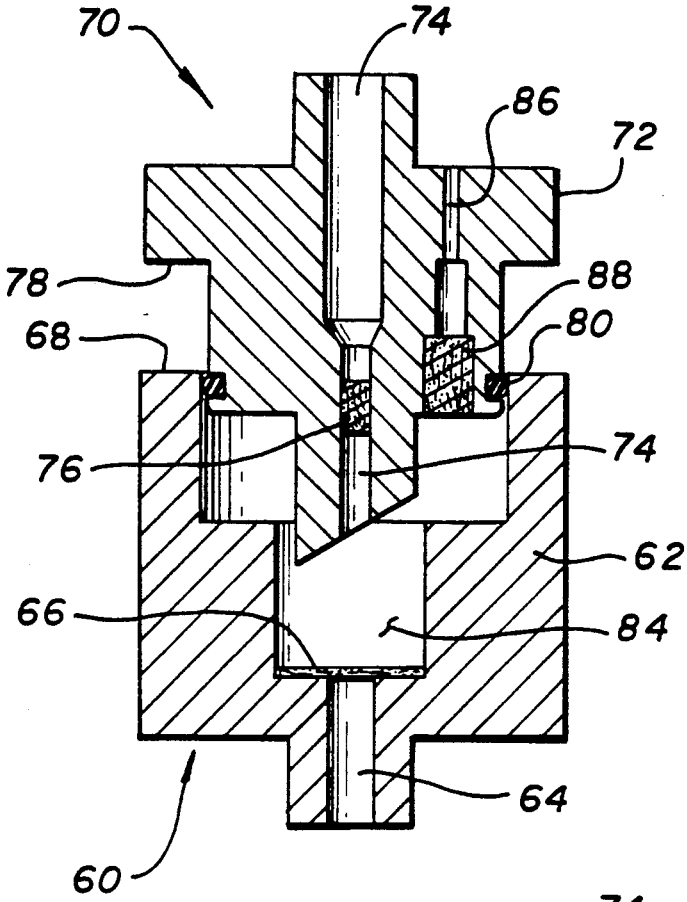
FIG. 3 is a cross-sectional view of the fluid bridge device of FIG. 2 illustrating its construction and a first connecting step in its operation.

FIG. 1 shows a printer ink cartridge 10 comprised of a housing 11 having a pair of parallel side walls 12, only one of which is shown, a peripheral wall 14 containing a collapsible ink bag 15 and an ink reserve chamber 20 therein. The bag 15 is comprised of a pair of rectangular flexible side panels 16, 17 secured together at their periphery and secured to the peripheral wall 14 of the housing as seen at 19. Bag 15 has a pair of spaced relatively rigid but lightweight metal plates 22, 23 therein which are urged apart from each other into engagement with the flexible side panels 16, 17 by a double bowed metal spring 25 so as to expand the collapsible bag 15. Printer ink cartridges in the past have been generally constructed in non-refill form to be discarded when the ink contained is depleted. As stated hereinafter, the invention concerns an arrangement for refilling ink cartridges such as 10 rather than expending them.

Ink from the bag 15 is discharged, as is known in the art, by a head (not shown) mounted inside housing 11 through an ink jet orifice (nozzle) or an arrangement of orifices in a printer nozzle plate indicated generally at 27 which provides for withdrawal of ink under computer control.

The rigid ink cartridge housing 11 has a divider wall **11*a* therein to one side of the ink bag 15 thereby defining a refillable ink reserve chamber 20 in the housing. The ink reserve chamber is connected by a suitable fluid conduit 30 to the flexible ink bag 15. A screw cap 32 covers a fill aperture which extends through the peripheral wall 14 of the housing into fluid communication with the ink refill chamber 20. A foam spray dampener mesh 34** may optionally be provided below the fill orifice to prevent backsplash of fluid during replenishment of the ink supply in the ink reserve chamber.

A capillary valve 40 comprised of a cylindrical block of capillary filter material is disposed in the fluid conduit 30 extending between the spring biased ink bag 15 and the refillable ink reserve chamber 20 to govern the flow of liquid ink therethrough. The capillary valve may be comprised of any ink compatible material which has an effective capillary force greater than the capillary force of the printer nozzle plate. The capillary valve filter material preferably comprises a high dirt capacity stainless steel woven wire mesh. One such filter material is sold under the trademark RIGIMESH by Pall Process Filtration Company of East Hills, New York. The RIGIMESH Type J sintered woven wire mesh filter having a nominal filter rating of 10 and an absolute rating of 25 in liquids is presently preferred. This filter readily passes ink from the reserve chamber 20 to the collapsible bag 15 which is maintained under sub-atmospheric or negative pressure by the action of the double bowed spring 25 such that the pressure in the spring bag 15 is at a lower pressure than the pressure in the reserve chamber 20 whereby ink is automatically sucked into the ink bag from the reserve chamber 20 through the capillary valve 40 in conduit 30.

The properties of the capillary filter material are such that it readily passes ink when both its inlet surface and its outlet surface are wetted with ink; however, the filter also acts as a valve thus preventing the flow of ink or air in either direction through the filter whenever the ink supply in the reserve chamber 20 is exhausted such that the inlet side of the valve 40 is no longer in a wetted condition. Subsequently, remaining ink in the spring biased ink bag 15 is drawn from the cartridge and discharged through the nozzle plate 27 during printer operation until the ink supply is completely exhausted. Such an arrangement has the advantage that ink supply in the flexible bag 15 need not be directly monitored, it being a rather simple matter to periodically remove the fill cap 32 and replenish the ink supply in the ink reserve chamber 20. A transparent window or sight gauge may be provided so that the ink level in the reserve chamber 20 can be visually monitored.

Turning now to FIG. 2, the arrangement is much the same as in FIG. 1 except that the ink reserve chamber 20 is not contained within the walls of the housing of the printer ink cartridge 10. Instead, the ink bag 15 in the cartridge is provided with a filling tube (not shown) which terminates in a closed connector 44 disposed in the peripheral wall 12 of the housing. A remote ink reserve chamber 20 of ink, which is also maintained at sub-atmospheric pressure by means not shown (so that ink will not leak from the remote filling container) is connectable to refill the spring biased ink bag 15 in the cartridge housing by means of a novel fluid bridge which employs a capillary valve construction similar to that used in the embodiment of FIG. 1. Specifically, the filling arrangement comprises a two part filling tube 50 having a mating female coupler 60 on one part 51 of the tube and a male coupler 70 on the end of the other part 52 of the tube to be joined therewith. The remote ends of the two tubes are respectively connectable to the remote ink reserve chamber 20 and to the inlet connector 44 on the cartridge housing.

Referring now to FIGS. 3, 4, 5 and 6, the fluid bridge device is shown in connecting, air purging, ink priming-/delivery and disconnect stages, respectively. In these figures, the female and male parts 60 and 70 of the fluid bridge are seen to respectively comprise a cylinder 62 which is connectable to the ink supply tube 51 and a piston 72 which is connectable to the ink delivery tube 52. Both cylinder and the piston have axially aligned ink supply and delivery passageways 64 and 74 therethrough. Capillary filters 66, 76, preferably of RIGIMESH, like filter 40 in FIG. 1, are provided in the ink supply and ink delivery passageways at the locations shown.

Figure 4:
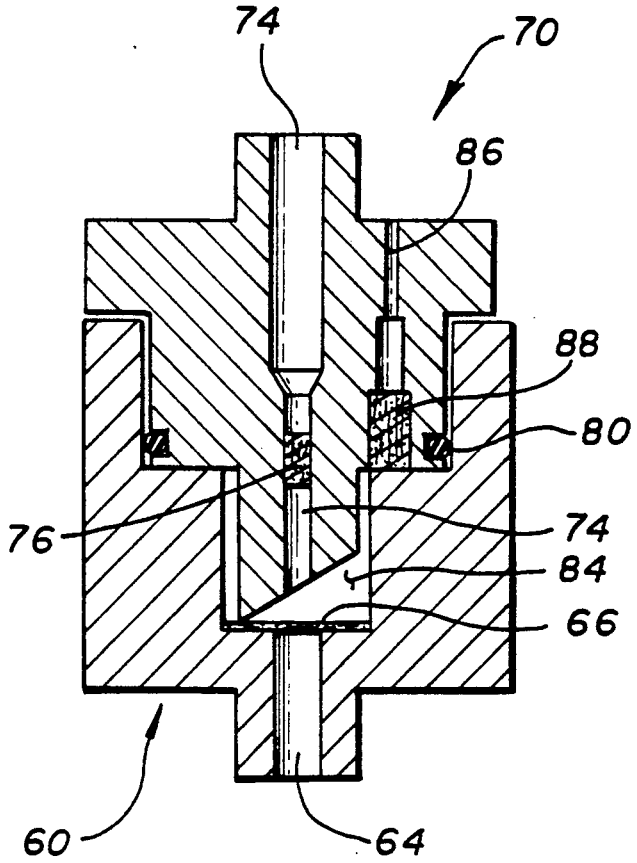
FIG. 4 is a cross-sectional view of the fluid bridge device of FIG. 2 showing the second step in its operation for purging air from its interior passages.
Figure 5:
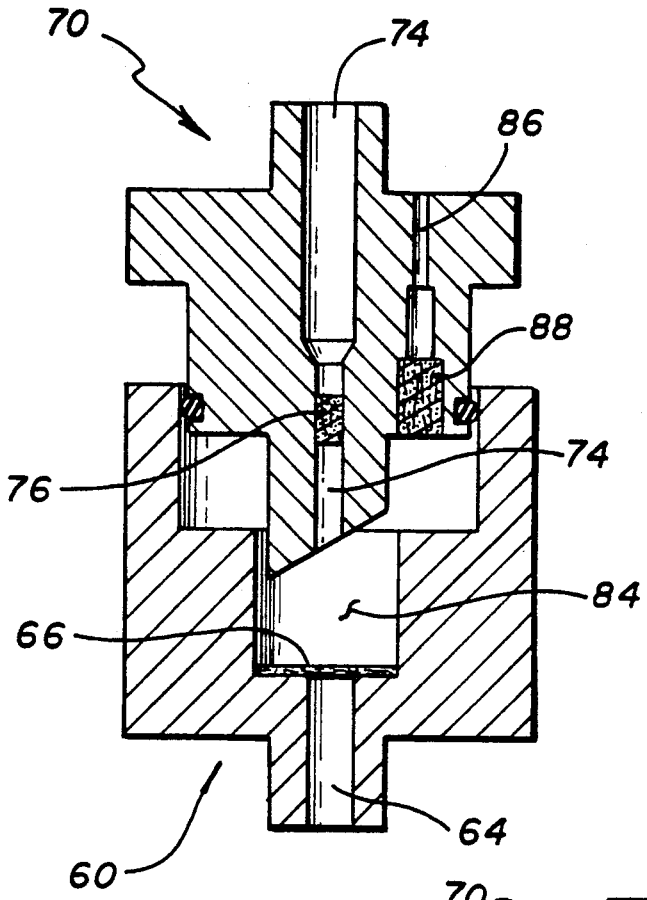
FIG. 5 is a cross-sectional view of the fluid bridge of FIG. 2 illustrating a third step for establishing a fluid bridge.

The piston 72 is slidable inwardly within the bore of cylinder 62, until shoulders 68, 78 disposed on the piston and cylinder come into abutment as shown in FIG. 4. The piston is slideably sealed in cylinder by O-ring 80 located in a groove on the piston 72. As in FIG. 3 then, it will be realized that air is entrapped in the space 84 therebetween. When the piston depressed downward into cylinder 62 (or the cylinder is pushed upward) the entrapped air in space 84 is exhausted through a vent passage 86. An enlarged portion of this passage contains a filter 88 of material permits the flow of air and which prevents flow of ink upwardly therethrough during the priming and ink transfer steps. Our presently preferred material for filter 88 is a sintered Teflon material sold under the trade name POREX. A further material suitable for filter 88 is a breathable waterproof fabric such as GORE-TEX which is manufactured by W. L. Gore & Associates, Inc. of Elkton, Md.

After the air is purged (FIG. 4), the piston 72 is then partially withdrawn from the cylinder 62 (FIG. 5) thus drawing ink into space 84 and creating a fluid bridge across capillary filters 6 and 76 whereby ink now continuously flows from the negative pressure remote ink reserve chamber 20 to the spring-biased ink bag 15 which is maintained at even lower negative pressure by the influence of the spring 25.

Figure 6:
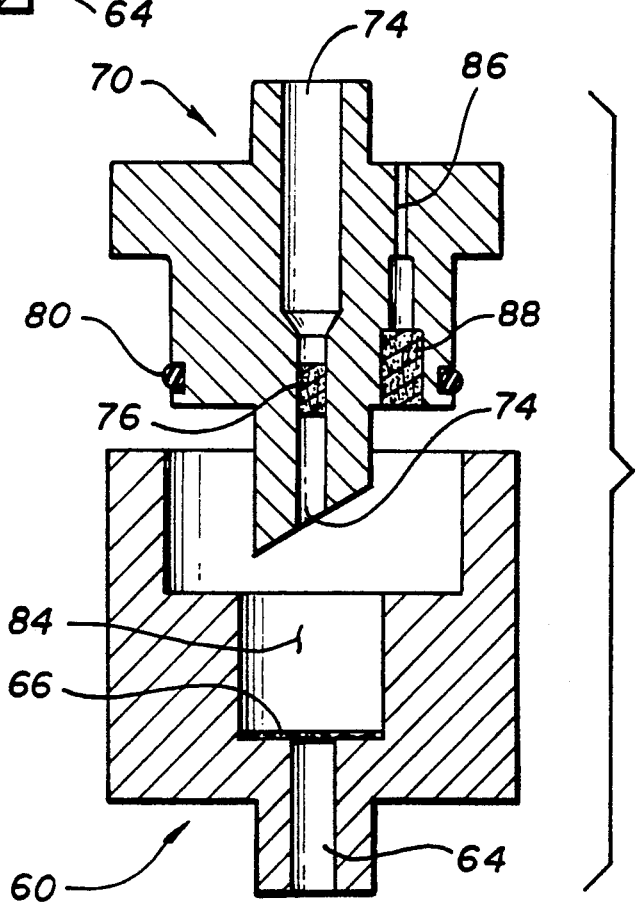
FIG. 6 is a cross-sectional view of the fluid bridge of FIG. 2 depicting the final disconnection step after the ink bag refill.

When the refilling of the ink bag 15 is accomplished, the piston 72 is withdrawn as illustrated in FIG. 6. Capillary filter 76 in the delivery passageway 74 has its lower end now exposed to air whereby the filter and the negative pressure in the spring biased ink bag 15 together prevent ink leakage back out of the delivery tube 52. Any residual ink which has drained into space 84 passes through the capillary filter 66 (since both sides thereof are wetted) and then through the ink supply tube 51 back into the negative pressure remote ink reserve chamber 20.

At this time, the ink delivery tube 52 can be disconnected from the printer ink cartridge. A capillary filter can also be provided in liquid passageway in the cartridge 10 between the delivery tube inlet connector 44 and the ink bag 15 as was shown in connection with the description of FIG. 1.

The structural elements of the combination may be constructed of common materials such as polyethylene or similar as long as the material is resistant to the chemicals of the ink.

Persons skilled in the art will readily appreciate that various modifications can be made from the preferred embodiment thus the scope of protection is intended to be defined only by the limitations of the appended claims.

We claim:

1. A printer ink cartridge comprising:

a) a rigid housing;

b) a collapsible ink bag in said housing;

c) an ink discharge head means in fluid communication with said ink bag for discharging printer ink from the cartridge;

d) means for maintaining said collapsible bag under sub-atmospheric pressure by biasing flexible walls of the bag away from each other;

e) means for replenishing ink to said ink bag;

f) a fluid passageway interconnecting said ink bag and said means for replenishing; and g) a capillary valve in said passageway, said capillary valve having an inlet surface and an outlet surface and being comprised of an ink compatible material which permits fluid flow therethrough only when said inlet surface and said outlet surface are wetted and which has an effective capillary force greater than a capillary force of said ink discharge head.

2. A printer ink cartridge according to claim 1, wherein said housing has a peripheral wall and a pair of spaced generally flat parallel side walls joined to said peripheral wall, said ink discharge head being mounted on said peripheral wall.

3. A printer ink cartridge according to claim 2, wherein said ink bag comprises a pair of side panels ink supply and ink delivery section joined at said edges to each other and to said peripheral housing wall.

4. A printer ink cartridge according to claim 3, further comprising a pair of rigid spaced plates and a spring in said bag urging said plates apart into engagement with said bag side panels for maintaining said sub-atmospheric pressure in said bag.

5. A printer ink cartridge according to claim 4 wherein said means for replenishing ink to said ink bag comprises a refillable non-collapsible ink chamber in said housing.

6. A printer ink cartridge according to claim 4, wherein said means for replenishing ink to said ink bag comprises a filling tube having an ink supply section connectable to a remote source of ink maintained at sub-atmospheric pressure, an ink delivery section connectable to said ink bag, tube connectors on said supply section and said delivery section for connecting said ink supply and ink delivery section together, and said capillary valve comprises a mass of capillary material disposed in at least one of said tube connectors.

7. A printer ink cartridge according to claim 6, wherein said connectors comprise mating male and female parts defining a chamber therein which is reduced in volume as said connectors are pushed together, and a vent in at least one of said parts for purging air from said chamber as said connectors are pushed together.

8. A printer ink cartridge according to claim 7, further comprising a filter in said vent which permits the flow of air but prevents the flow of liquid therethrough.

9. A printer ink cartridge according to claim 7, wherein said capillary valve comprises a mass of capillary material disposed in each of said tube connectors.

10. A printer ink cartridge according to claim 9 in which said capillary material comprises an assembly of wettable fibers through which fluid flow is established through a fluid-to-fluid interface.

11. A method of replenishing spent ink in a printer ink cartridge having a cartridge housing, comprising the steps of:

a) filling an ink reserve chamber located remotely from said cartridge;

b) drawing ink from said reserve chamber through an elongate tube having a pair of connectors therein and through a capillary filter located in at least one of said connectors into a collapsible ink bag located in said housing having opposed walls, said bag being maintained under negative pressure in said housing by moving said walls of said bag away from each other to expand a volume of the bag; and c) using said capillary filter as a valve to prevent air from entering said collapsible bag during said ink drawing step.

12. The method of claim 11, wherein said reserve chamber is located in said cartridge housing.

* * * * *